US005961253A

United States Patent [19]

Okawa

[11] Patent Number: 5,961,253

[45] Date of Patent: Oct. 5, 1999

[54] PILE HEAD DRESSER, PILE HEAD DRESSING METHOD, AND, PLACEMENT OF CAST-IN-PLACE CONCRETE PILES

[76] Inventor: Shogen Okawa, 11-5, Matsuehigashi 4-chome, Wakayama-shi, Wakayama 640, Japan

[21] Appl. No.: 08/836,696

[22] PCT Filed: Nov. 27, 1995

[86] PCT No.: PCT/JP95/02438

§ 371 Date: May 15, 1997

§ 102(e) Date: May 15, 1997

[87] PCT Pub. No.: WO96/18001

PCT Pub. Date: Jun. 13, 1996

[30] Foreign Application Priority Data

| | | | |
|---|---|---|---|
| Dec. 5, 1994 | [JP] | Japan | 6-300583 |
| Sep. 5, 1995 | [JP] | Japan | 7-228215 |
| Oct. 31, 1995 | [JP] | Japan | 7-283645 |

[51] Int. Cl.[6] ..... E02D 5/34; E04B 1/16; E04C 5/18

[52] U.S. Cl. ..... 405/239; 405/243; 405/249; 405/255; 405/257; 52/301; 52/745.18; 249/51

[58] Field of Search ..... 405/233, 239, 405/243, 249, 255, 257; 52/301, 745.17, 745.18, 741.15; 249/48, 51

[56] References Cited

U.S. PATENT DOCUMENTS

| | | | |
|---|---|---|---|
| 2,571,549 | 10/1951 | Dunning . | |
| 3,396,546 | 8/1968 | Pleuger | 405/243 |
| 3,487,646 | 1/1970 | Gatien | 405/257 |
| 4,040,260 | 8/1977 | Pryke | 405/243 X |
| 4,472,085 | 9/1984 | Mohler | 405/255 |
| 5,359,829 | 11/1994 | Voita | 405/239 X |
| 5,423,633 | 6/1995 | Verstraeten | 405/255 X |

*Primary Examiner*—David Bagnell
*Assistant Examiner*—Tara L. Mayo
*Attorney, Agent, or Firm*—Wenderoth, Lind & Ponack, L.L.P.

[57] ABSTRACT

A pile head dresser, for cast-in-place concrete piles, has an inner cylinder (2) adapated to permit a tremie pipe (16) to move in and out. The inner cylinder is surrounded by an outer cylinder (3). A top plate (1) and a bottom plate (6) interconnect the inner and outer cylinders (2, 3) so as to form a double cylinder structure (A). The bottom plate (6) has a plurality of reinforcement bar apertures (8) provided therein at equal intervals of a specified distance. Also, the top and bottom plates (1, 6) are provided with exhaust apertures (5, 9) for allowing a mixture of air and slurry to pass therethrough.

10 Claims, 18 Drawing Sheets

6A
1A
B 2A
3A
1A
B 3A
2A
7A
1A
B 2A
7A
3A
4A
B 2A
3A
4A
B 6A
2A
3A
4A
B

PILE HEAD DRESSER, PILE HEAD DRESSING METHOD, AND, PLACEMENT OF CAST-IN-PLACE CONCRETE PILES

BACKGROUND OF THE INVENTION

1. Field of the Invention

The present invention relates to a pile head dresser which is mounted to the head of a steel cage of a cast-in-place concrete pile installed in the ground for making a foundation for civil engineering work, to a method of dressing the head of such a concrete pile, and to an improvement in placement of such a pile.

2. Description of Related Art

In common construction work, a variety of methods are used for driving and installing foundation piles. Among of them is a popular cast-in-place pile installation method.

The cast-in-place concrete pile installation method comprises drilling a round hole into a bearing base layer in the ground by an earth drilling technique, installing in the drilled round hole a steel cage consisting of a framework assembly of reinforcement bars, and filling the hole with a batch of concrete which is supplied through a tremie pipe having been inserted from above into the steel cage. A reinforced concrete pile is formed when the concrete is solidified.

In general, the batch of concrete is abundant thus having an extension of about 1 meter high above the steel cage of the concrete pile. The concrete pile with the extension is covered with refilling soil for curing.

After the curing of the concrete is completed, the soil is removed and the concrete extension is chipped off to expose the reinforcement bars at the top of the steel cage. The foundation of a building structure is then built on the concrete piles.

The chipping of the concrete extensions however creates unwanted sounds, vibrations and dust and is generally regarded as a public nuisance. Also, it may damage the reinforcement bars and cause labor accidents and industrial illnesses. The concrete extensions require a considerable amount of concrete and the chipping procedure increases the overall construction cost and time.

A method of eliminating the chipping procedure is disclosed in Japanese Patent Application 61-186616 (1986) where the concrete extensions are removed while the concrete, supplied through a tremie pipe, remains in a viscous fluid form before being solidified. The removal of the concrete is achieved by vacuum suction with a suction hose coupled to a heavy-duty vacuum pump. The method is only feasible with the use of a casing installed in the drilled hole and is not satisfactorily applicable to any different case where the drilled hole may easily collapse.

According to the method, the reinforcement bars are exposed and directly covered by refilling soil when the concrete extensions have been removed. Also, the removal of the concrete extensions requires a large machine which may easily damage the top of the exposed reinforcement bars. As the injured reinforcement bars have to be repaired with extra care and cost, the method is rather impractical.

To prevent such damage to the exposed reinforcement bars during the chipping or removal of concrete extensions, a reinforcement bar cap structure has been introduced as disclosed in Japanese Patent Application 58-153816 (1983).

The cap has a through hole provided in the center thereof for accepting and detachably coupling a tremie pipe. The cap comprises a closed double-wall structure of a doughnut shape having two separate rooms or spaces about the center hole which are defined by two, top and bottom, annular plates provided with apertures.

In use, joint bolts are inserted through the apertures of the top or bottom plate of the cap and threaded into sleeve joints of which rear ends are mounted to the uppermost ends of reinforcement bars of a steel cage so that the cap structure and the steel cage are tightly joined to each other. This is followed by introduction of a flow of concrete through a tremie pipe.

The flow of concrete into the steel cage is continued until the cap structure on the top of the steel cage is filled up. For curing the concrete in the steel cage, the steel cage and the cap are covered with refilling soil. When the concrete has been cured, the refilling soil is removed to expose the cap. The concrete in the cap structure is chipped off and retaining screws are removed so as to unlock the cap. After the joint bolts are separated from their respective sleeve joints, the cap structure is removed. Anchor bars are then threaded into the sleeve joints so that they extend upright from the reinforcement bars.

With the use of such a cap structure, the extensions of concrete piles are decreased in size but still require a chipping process for removal. The cap structure is not simple as it includes two parts which are joined to each other using side plates in an extra step of an assembling procedure. The anchor bars are threaded into their respective sleeve joints in order to increase a total length of the reinforcement bars. This is a rather delicate operation because it is hard to verify the mechanical strength thereof and it depends primarily on experimental skills. If the mechanical strength is worse, the means may cause critical accidents. It is said that the means is still being refined in order to overcome all of the technical drawbacks.

Some modifications of such a cap structure or a pile head dresser (the former being used hereinafter) for use in installing bearing piles have been developed, including one which is invented by he present inventors and is disclosed in Japanese Patent Application 1-322020 (1989).

The cap structure invented previously by the present inventors, unlike the conventional cap of a doughnut shape having two separate spaces and disclosed in the previously described application 58-152816, comprises an inner cylinder (tremie pipe introducing tube) arranged open at upper and lower ends for freely accepting a tremie pipe, and an outer cylinder (cap upper) disposed outwardly of the inner cylinder for coupling top and bottom plates, thus forming a simple double-cylinder structure. Also, the bottom plate has a plurality of reinforcement bar apertures provided in an outward region thereof (cutting projected face dish). The terms in parenthesis represent the counterpart structures in the previous Application.

Our previous cap structure of a cylindrical shape has a size substantially equal to the concrete extension and greater in depth than the conventional cap (structure) shown in Application 58-153816. In use, the cap structure is fitted onto the reinforcement bars so that its top plate comes into direct contact with the top of the reinforcement bars. Then, a tremie pipe is inserted into the inner cylinder for placement of concrete without forming a concrete extension. For curing the concrete, the cap structure is covered with refilling soil.

After the curing is completed, the refilling soil is removed to expose the cap structure. Since chipping work is not necessary, the reinforcement bars are exposed when the cap structure has carefully been removed. It is only necessary to remove the remaining concrete slime from the bottom of the inner cylinder while care is taken so as not to injure the reinforcement bars. After other unwanted deposition and slurry are removed, the concrete placement is finished.

It is well known that a conventional method of concrete placement comprises the steps, shown in FIG. 19(A) to 19(G), of placing a surface protective casing 7B and a steel cage 7C in a drilled hole 7A, removing a sediment of slime 7D from the bottom by means of an air lift or suction pump, and filling the drilled hole with a batch of concrete 7F supplied through a tremie pipe 7E. Also, an extension of concrete 7G is added to the pile concrete 7F for a predetermined height during the filling step. The concrete extension 7G contains impurities of slime and laitance and has to be chipped off after solidified.

The step of removing the slime sediment from the bottom is necessary for avoiding a reduction in the quality of a finished concrete pile caused by residual slime. It may be executed by suction with a known air lift or suction pump. Simultaneously, it is necessary to replace the slime sediment with a fresh supply of water for preventing lowering of a water level which may cause collapse of the inner wall. This will disturb the efficiency in carrying out the step. Technically, the removal of the slime sediment is very difficult and the concrete extension 7G is provided for compensation.

Our previous cap structure disclosed in the Application 1-322020 is designed for protecting the head of a pile as well as eliminating forming and chipping of the concrete extension which are essential in the prior art. Accordingly, as the chipping process is eliminated, no environmental problems will occur. Also, the overall procedure will be simplified and the consumption of concrete will be minimized, thus reducing the overall costs.

It is still troublesome to remove the remaining concrete slime from the inner cylinder when the concrete has been placed, covered, and solidified. Although the removal of the remaining concrete slime is carried out by in simple manner such as drilling the concrete along a cut line, splitting it with the use of wedge laggings or expanders, and lifting up the split concrete slime with ropes, it may preferably be omitted.

The bottom of the previous cap structure is flat and will be likely to accumulate and hold sediments of concrete slime or impurities. It is also essential to allow a liquid stabilizer used for preventing collapse of the inner wall and a water inflow welling up so as to pass smoothly through the cap structure and between the cap structure and the casing while exerting as small a pressure as possible on the cap structure. It is thus an object of the present invention to solve the foregoing problems attributed to the previous cap structure of a closed form having only reinforcement bar apertures.

It is another object of the present invention to provide an improved concrete placement method which avoids the procedure of removing sediments of concrete slime and allows a minimum of slime to enter the concrete.

SUMMARY OF THE INVENTION

For achievement of the objects of the present invention, a pile head dresser for cast-in-place concrete piles includes an inner cylinder arranged for allowing a tremie pipe to move in and out, and surrounded at a distance by an outer cylinder 3, and a top plate 1 and a bottom plate 6 joining the two cylinders 2 and 3 at top and bottom respectively to form a double cylinder structure A. The bottom plate 6 has a plurality of reinforcement bar apertures 8 provided therein at equal intervals. The top and bottom plates 1, 6 have exhaust apertures 5 and 9 respectively provided therein for passing a mixture of air and slurry.

Also, a pile head dresser for cast-in-place concrete piles according to the present invention is arranged such that the inner cylinder 2 and the outer cylinder 3 are equal in the length to each other, and the top and bottom plates 1, 6 extend horizontally between the two cylinders 2 and 3.

The present invention further includes a pile head dresser for cast-in-place concrete having a cap structure of a double cylinder construction. The cap structure has a top plate 1 of an outer cylinder 3 having a plurality of exhaust apertures 5 provided in an outward edge region thereof for passing a mixture of air and slurry and also has an upper tremie opening 4 provided in a center thereof for allowing a tremie pipe 16 to move in and out for supplying a batch of concrete for placement, and an inner cylinder 2 having both ends thereof opened and arranged shorter by 2% to 3% rather to the outer cylinder. In particular, the outer cylinder is coupled to a bottom plate which has a plurality of reinforcement bar apertures provided in an outward edge or flat region 6*a* thereof. The apertures are spaced at equal intervals and a plurality of slits 9 are provided at equal intervals and extend radially from a lower tremie opening 7 formed in a center of the bottom plate 6 to the flat region 6*a* so as to define a group of slit tabs 9*a*. The slit tabs 9*a* are folded upward and their distal ends are welded to the lowermost ends of the inner cylinder 2.

The present invention further includes pile head dressers for cast-in-place concrete piles arranged such that the top plate 1 and/or bottom plate 6 is made of a mesh or perforated metal sheet.

The present invention further includes pile head dressers for cast-in-place concrete piles arranged such that the cap structure is mounted on and fixedly tied to a steel cage by at least a pair of detachable chains, wires, or cables before both are installed in a drilled hole.

Further, pile head dressing methods for cast-in-place concrete piles according to the present invention employ the above pile head dressers and comprise joining the cap structure to the steel cage by stud welding, installing both in the drilled hole, inserting the tremie pipe through the inner cylinder of the cap structure into the drilled hole, pouring a batch of concrete continuously into the same until the level of the concrete rises from the bottom of the drilled hole to the top of the inner cylinder, and removing sediments of concrete slime from the inner cylinder without delay by a rotating action of a digger bucket mounted to a kelley bar.

Further, a cast-in-place concrete pile placing method according to the present invention where a steel cage is installed in a drilled hole and a batch of concrete is poured into it, comprises setting the steel cage in a bag enclosure having a cylindrical structure with a closed bottom made of a sheet material and filling the bag enclosure with the concrete.

Further, a cast-in-place concrete pile placing method according to the present invention comprises preparing a bag enclosure which is made of a sheet material having a bottomed cylindrical structure and has a longitudinally extending slit provided in the side thereof and a fastener arranged along the slit, installing across the opening of a drilled hole the bag enclosure in a rolled form with the fastener being opened, tightening a slider of the fastener which remains located at the opening of the drilled hole, lowering a steel cage into the drilled hole together with the bag enclosure so that the fastener of the bag enclosure is closed to shut the slit of the cylindrical structure while water inflow in the drilled hole has flown through the slit into the bag enclosure.

DETAILED DESCRIPTION OF THE INVENTION

Figure 1:
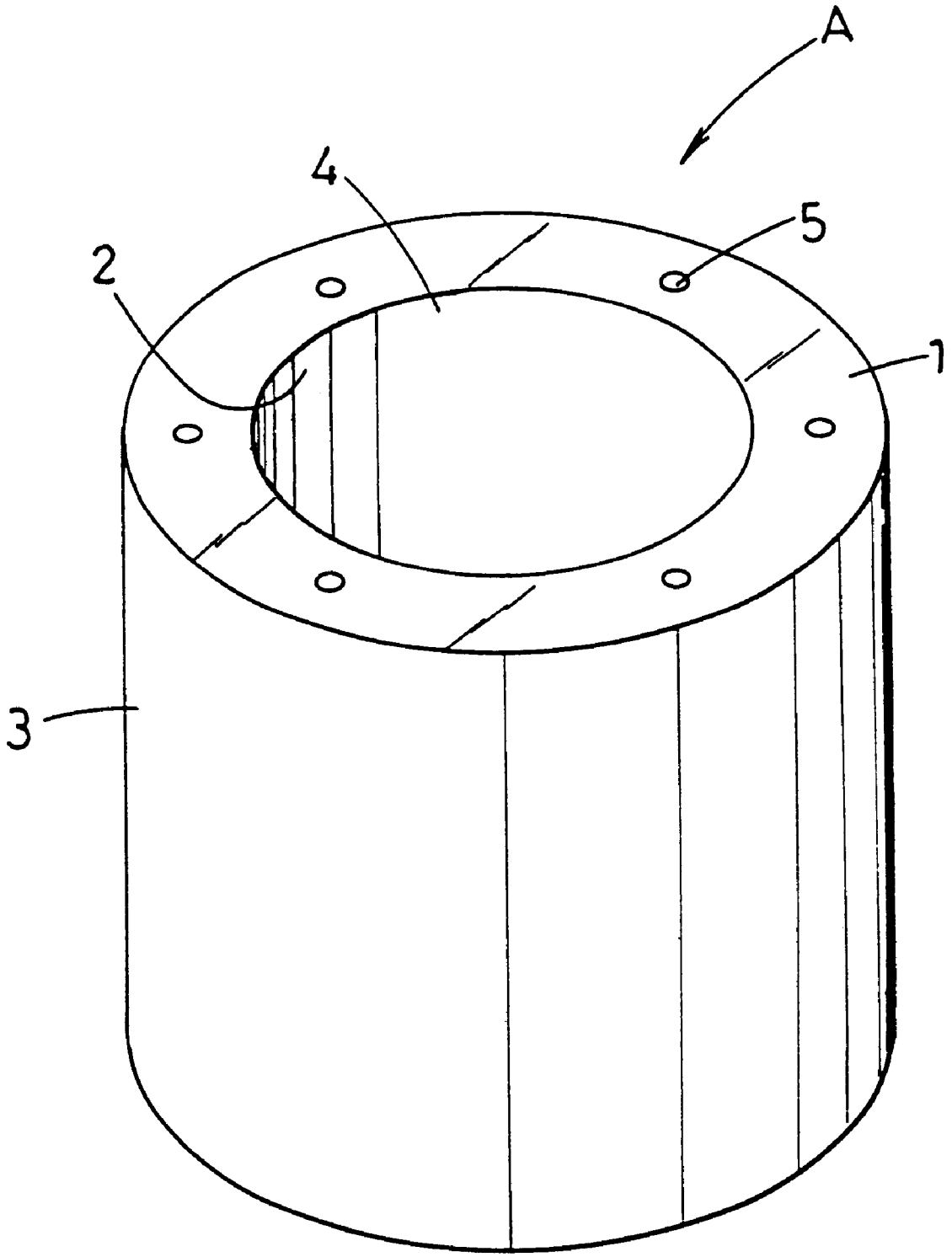
FIG. 1 is a perspective view of a cap structure.

As shown in FIGS. 1 to 7, an outer cylinder 3 has a top plate 1 mounted to the upper end thereof so as to define a round central upper tremie opening 4 into which a tremie pipe 16 is inserted to supply a flow of concrete for placement. An inner cylinder 2, which is slightly shorter in length than the outer cylinder 3, extends downwardly from the top plate 1 vertically of the upper tremie opening 4, thus forming a bottom-open double cylinder structure of the cap structure A. The top plate 1 of the outer cylinder 3 has a plurality of exhaust apertures 5 provided in an outer peripheral region thereof. The bottom plate 6 of the outer cylinder 3 has a lower tremie opening 7 provided in the center thereof, and the opening is similar in size to the upper tremie opening 4.

The bottom plate 6 has a series of reinforcement bar apertures 8 provided in an outer peripheral region thereof at substantially equal intervals for accepting pile reinforcement bars 11 of a steel cage 14. In addition, the bottom plate 6 has slits 9 provided therein at equal intervals. The slits 9 are located between the reinforcement bar apertures 8 and extend radially from the lower tremie opening 7 to a flat region 6*a* of the bottom plate 6. The slits 9 form tabs 9*a* in the bottom plate 6, and the tabs are bent upwardly and welded at their distal end to the lowermost end of the inner cylinder 2, thus completing the structure of the cap structure A. As a result, a bottom space 10 of an inverted pan shape is created in the bottom of the cap structure A as defined by the slit tabs 9*a* of the bottom plate 6. This arrangement allows a mixture of air and slurry to escape smoothly through the slits 9 of the bottom plate 6 and the exhaust apertures 5 of the top plate 1 between the inner and outer cylinders 2, 3 during pouring of the concrete. Accordingly, as the pressure from below is remarkably reduced, the major problem of accumulating impurities of sediment including slime and laitance on the bottom plate will be minimized.

The cap structure A is fitted onto the upper end of the steel cage 14 which is then installed in a drilled hole 17. The drilled hole 17 is filled with a batch of concrete which is supplied through the tremie pipe 16 and distributed continuously from the bottom of the drilled hole 17 to produce a steel-bar reinforced concrete pile. Through a series of experiments, we found that a remaining portion of concrete slime held substantially in the inner cylinder 2 can readily be removed immediately after the concrete placement by a modification of the common digging method, i.e. rotating a kelly bar 19 equipped with a digger bucket 18 or slime bucket.

The cap structure A is then protected with an applicable lid and covered up with refilling soil by a known manner after removal of a casing 13.

When the concrete has been cured, the cap structure A is uncovered by removing the refilling soil and separated from the steel cage 14 by means of a gas burner or a mechanical device such as a power shovel. According to the embodiment of the present invention, the chipping procedure is not used and thus its inherent technical problems are eliminated which allows the reinforcement bars 11 to remain intact and offers an economical advantage.

Figure 2:
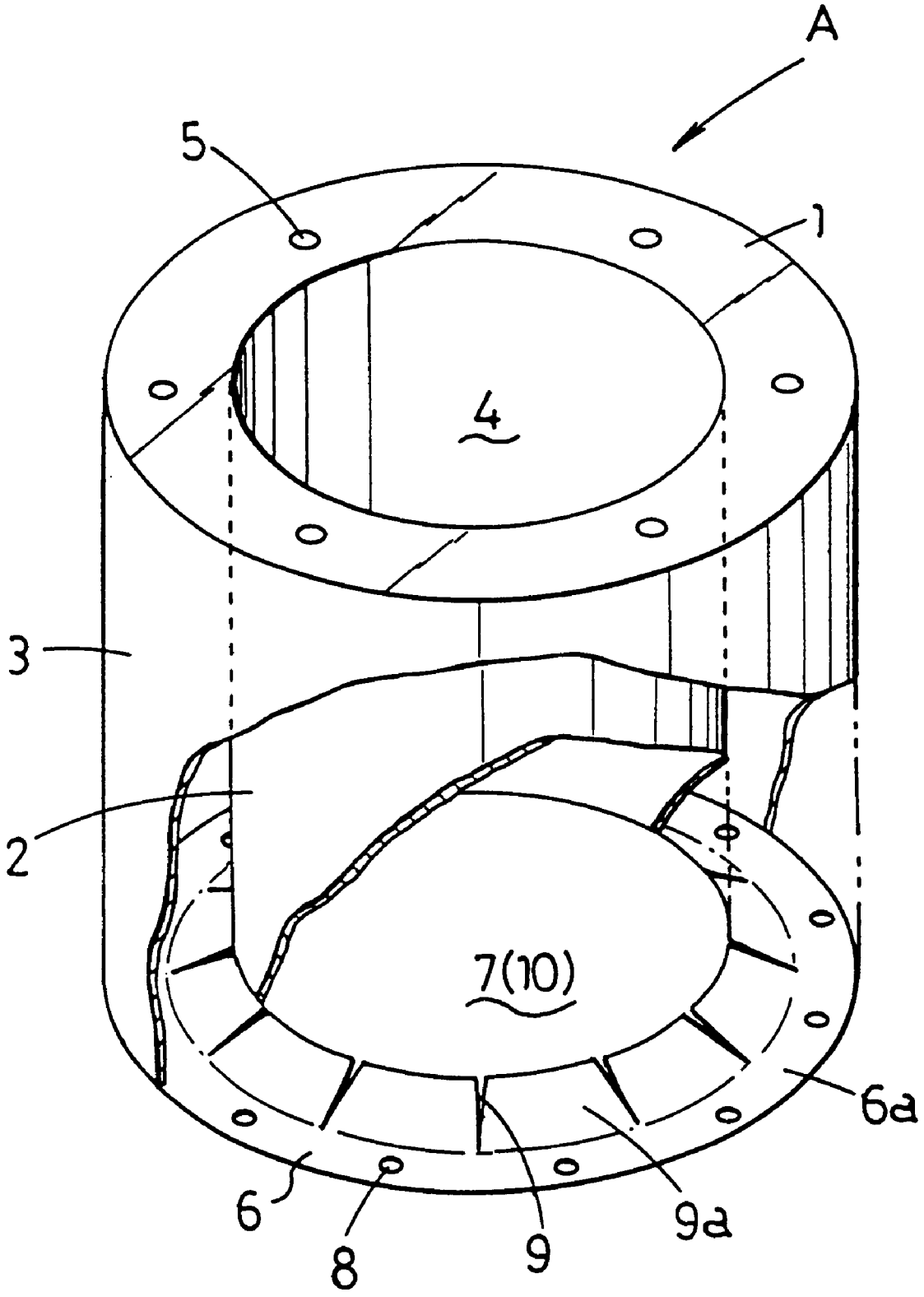
FIG. 2 is a partially cut-away perspective view of the cap structure.
Figure 3:
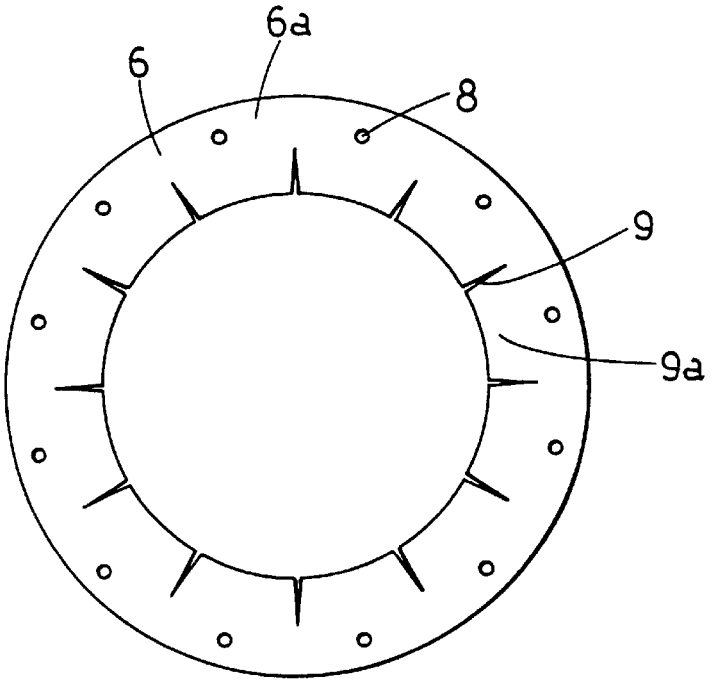
FIG. 3 is a plan view of a bottom plate of an outer cylinder of the cap structure before it is bent.

As shown in FIGS. 1 to 3, the cap structure A includes the top plate 1 having an annular shape defining the upper tremie opening 4. The inner cylinder 2 is joined to the inner edge of the top plate 1, the outer cylinder 3 is joined to the outer edge of the top plate 1, and the bottom plate 6 has an annular shape and defines the lower tremie opening 7. The bottom plate 6 is joined at its inner edge to the lowermost end of the inner cylinder 2 and at its outer edge to the lowermost end of the outer cylinder 3. Accordingly, the cap structure A has a double-cylinder construction.

The inner cylinder 2 is shorter by 2% to 3% than the outer cylinder 3. The difference may be determined by considering a diameter difference between the upper and lower tremie openings 4, 7. In addition, the distance between the two adjacent slits 9 may also be decided depending on the conditions of the particular application.

Figure 6:
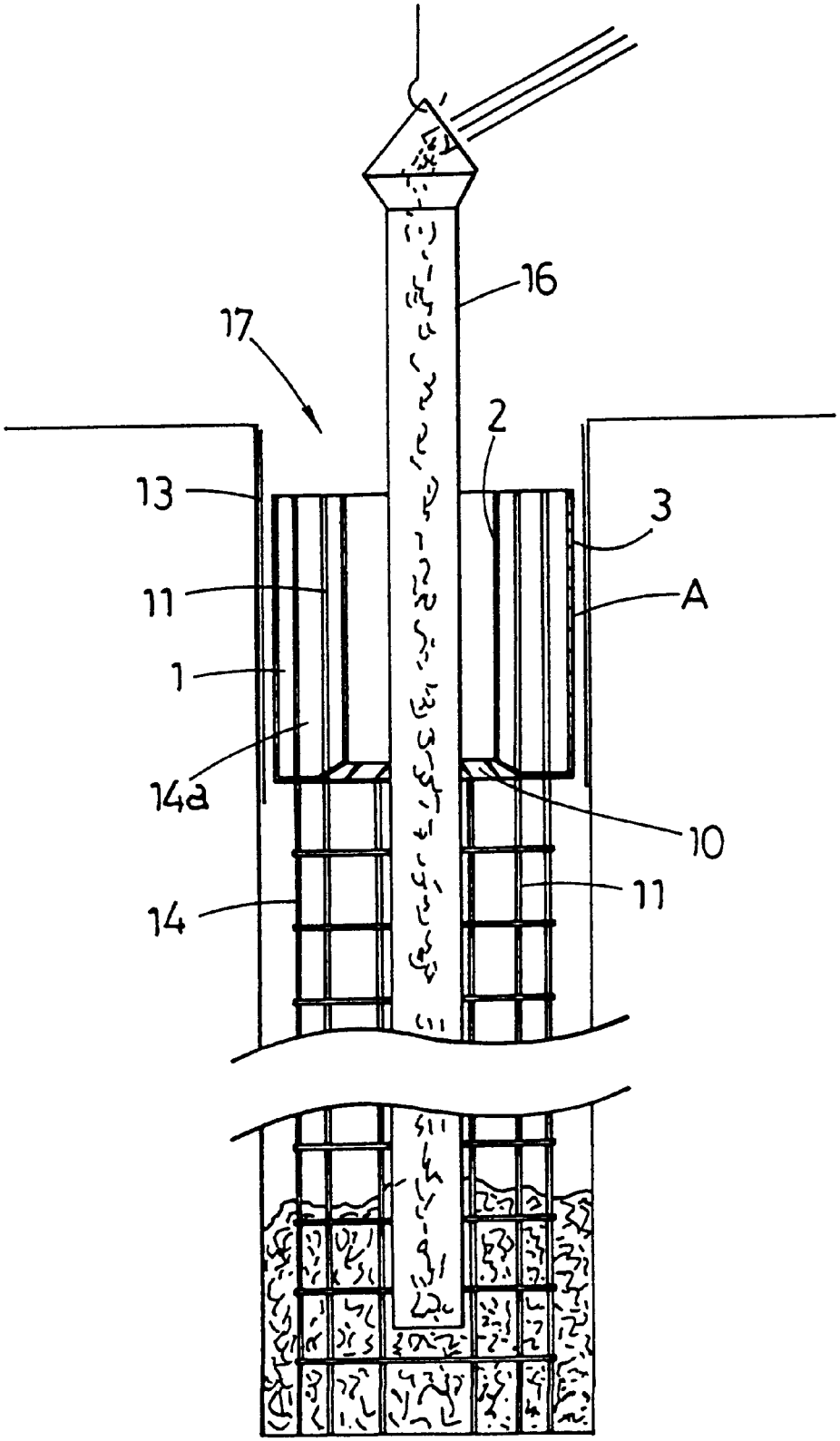
FIG. 6 is another explanatory view showing the cap structure in use.
Figure 7:
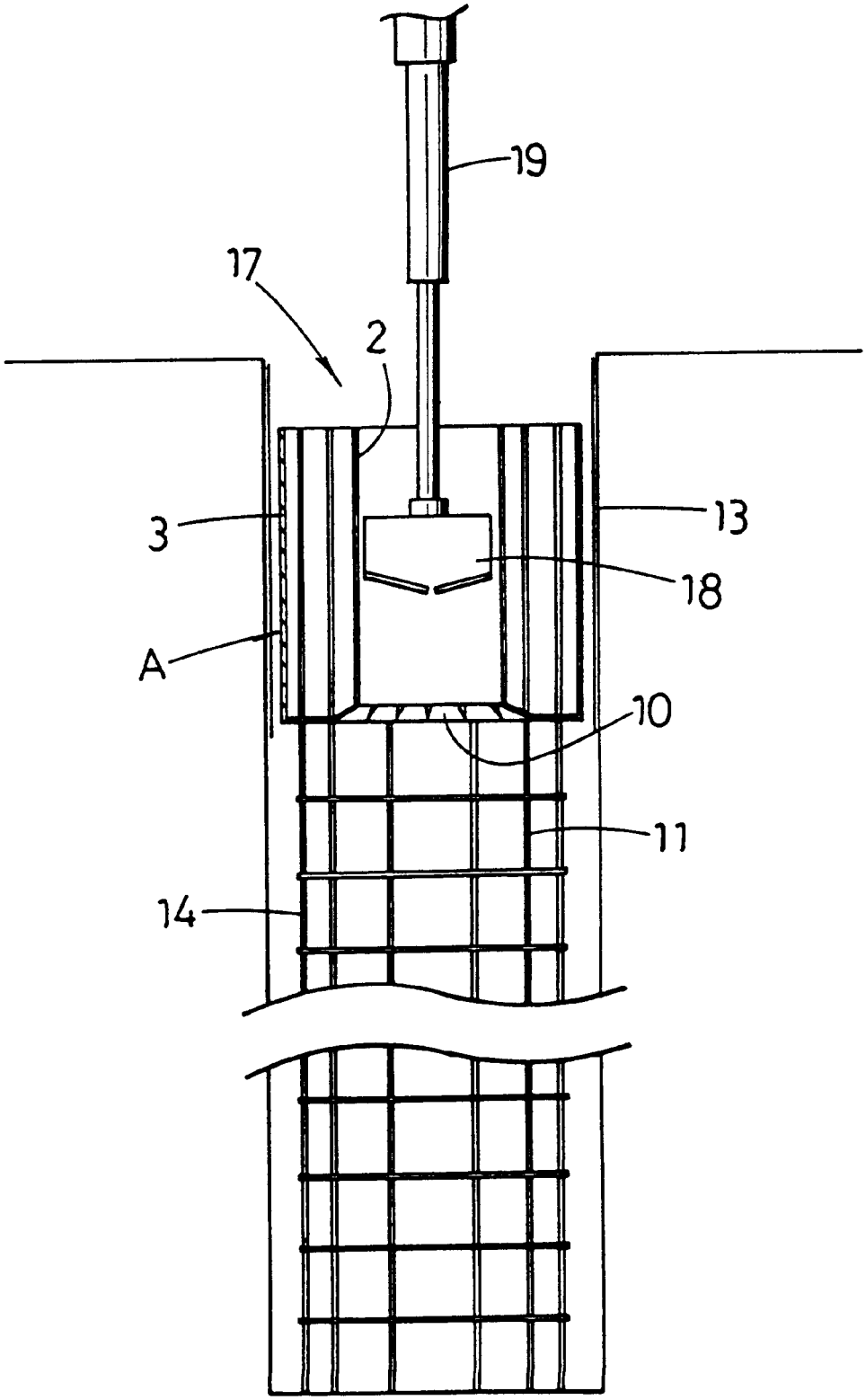
FIG. 7 is an explanatory view showing removal of concrete from the cap structure.

The size of the cap structure A may be determined by the dimensions of the steel cage 14 and the diameter and number of the reinforcement bars 11 which correspond to the size of the drilled hole 7 (See FIG. 6). Preferably, a head extension 14*a* (a base of foundation of a building structure) of the steel cage 14 in the drilled hole 17 is equal to 40 or more times the diameter of the reinforcement bar 11. As the extension 14*a* represents the concrete extension of the prior art, and it is the basis for determining the height of the cap structure A.

The material of the cap structure A is preferably a soft steel sheet of 1.6 mm to 3.2 mm thick which has a strength required for protection during the refilling and the re-digging and can be easily handled for removal. It is understood that the material is not limited to the soft steel sheets but may be selected from synthetic resins or other metals. The cap structure A is fabricated in the following manner.

As shown in FIG. 2, the annular top plate 1 and bottom plate 6 are shaped so as to be of the same diameter. The upper tremie opening 4 is provided in the center of the top plate 1 for accepting a common tremie pipe 16 (FIG. 6) for supplying a flow of concrete. Also, a plurality of the exhaust apertures 5 are provided in the outer edge region of the top plate 1. The diameter and number of the exhaust apertures 5 may be determined depending on the size of the top plate 1. Preferably, the diameter is 10 mm to 20 mm and the number is 4 to 8.

The bottom plate 6 has the flat regions 6*a* arranged at equal intervals of a predetermined distance (e.g. 90 mm) along the outer edge thereof and also has the equally spaced reinforcement bar apertures 8 therein so that each reinforcement aperture 8 is between the two adjacent flat regions 6*a* for accepting the reinforcement bar 11 of a steel cage 14, as best shown in FIG. 3. The diameter of the reinforcement bar aperture 8 is as large as about 1.3 to 1.5 times the diameter of the reinforcement bar 11.

Figure 4:
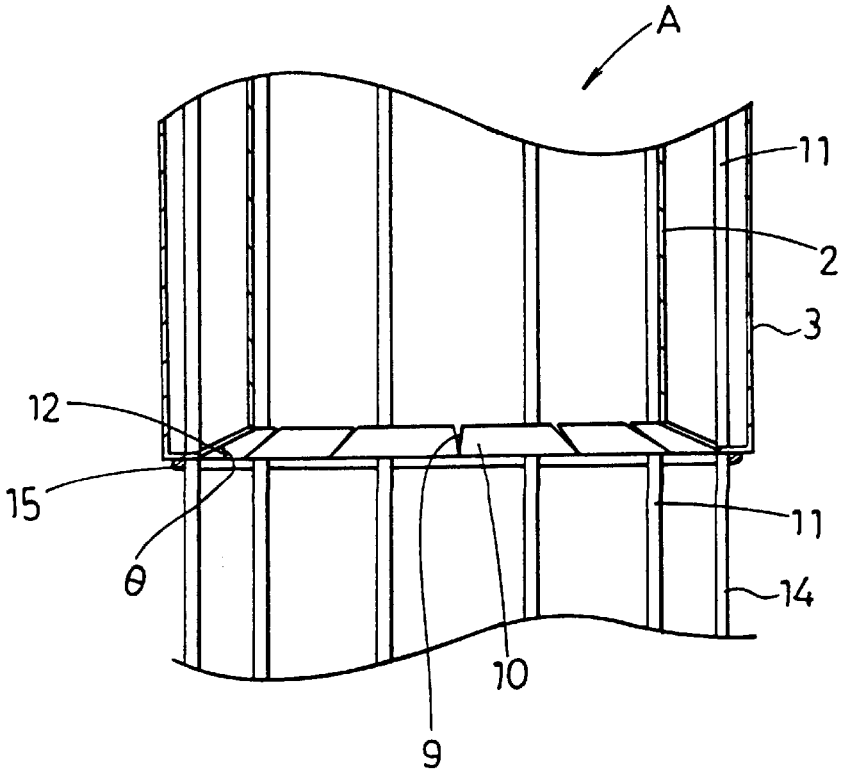
FIG. 4 is a partially cut-away longitudinal cross sectional view of the cap structure.

The lower tremie opening 7 is formed in the center of the bottom plate 6 and is smaller by 2% to 5% in diameter than the upper tremie opening 4. The tabs 9*a* of the bottom plate 6, which are defined by the radially extending slits 9, are arranged at substantially equal intervals and are bent so as to tilt at an angle θ, namely 25 to 35 degrees, with respect to the horizontal so that the diameter determined by the distal ends of the tabs 9*a* is substantially identical to that of the upper tremie opening 4. The distal ends of the tabs 9*a* of the bottom plate 6 are welded to the lowermost end of the inner cylinder 2, thus forming an inverted pan shaped space under the cap structure A communicated through the slits 9 as shown in FIG. 4.

As the cap structure A has a double-cylinder construction with the inverted pan shaped space at the bottom, the slits 9 and the gap formed between each aperture 8 and the reinforcement bar 8, and the bottom plate 6 allows a mixture of air and slurry to run upward between the inner cylinder 2 and the outer cylinder 3 and escape through the exhaust apertures 5 of the top plate 1. More specifically, this arrangement is tended to attenuate the upward pressure created by the mixture of air and slurry swelling in the drilled hole 17. In addition, the inverted pan-shaped space allows a sediment of slime to be rarely deposited on the bottom of the cap structure A.

For assembly of the components of the cap structure A, the inner cylinder 2 is lowered through the upper tremie opening 4 of the top plate 1 and welded to the top plate 1. Then, the bottom plate 6 is joined to the lowermost end of the inner cylinder 2 thus defining the lower tremie opening 7. Finally, the outer cylinder 3 is welded to the top plate 1 and the bottom plate 6. In the embodiment, the welding is carried out by a stud welding method which may create more gaps in the cap structure A and allow ease of disassembling.

Figure 5:
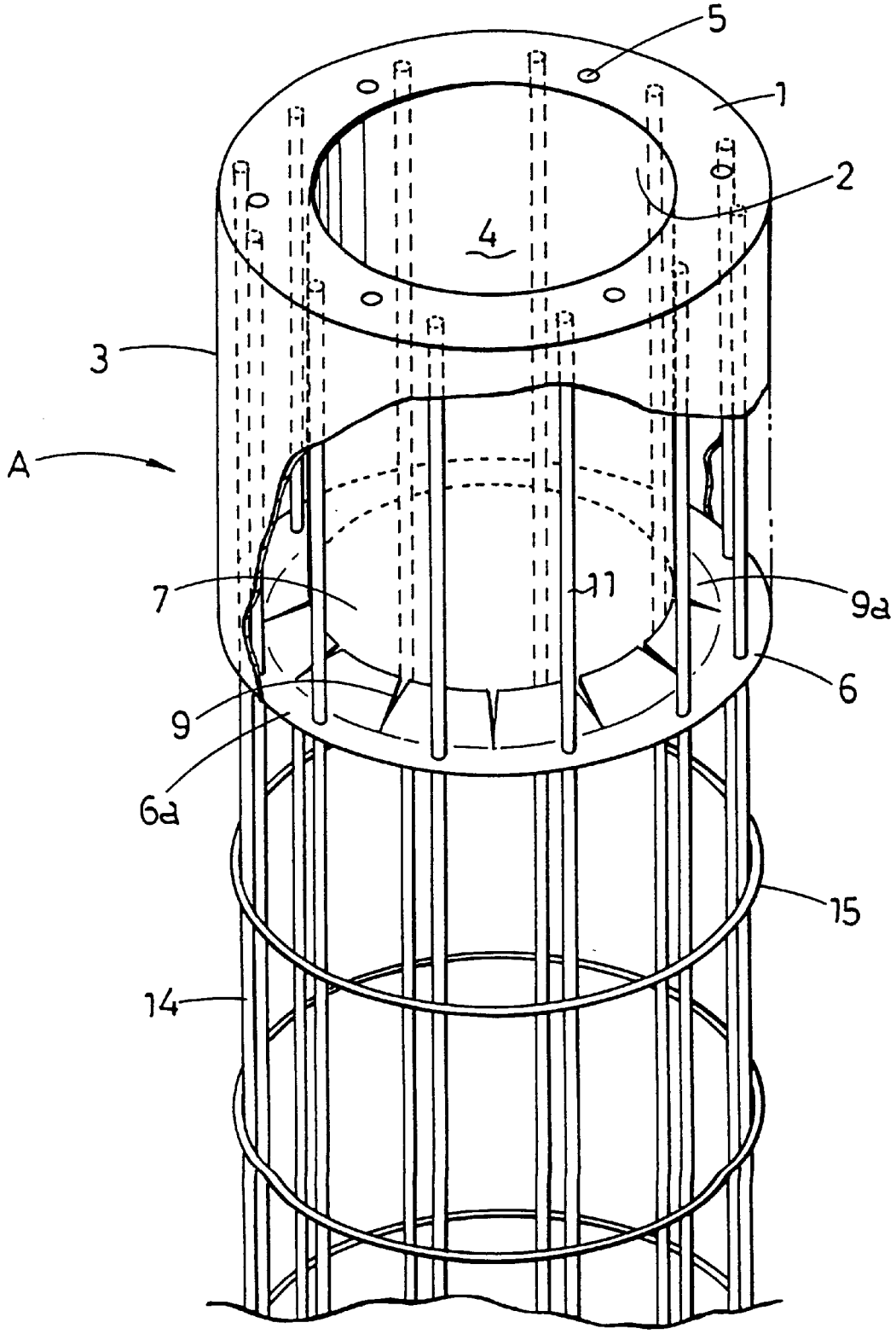
FIG. 5 is an explanatory view showing the cap structure in use.

The cap structure A is fitted to the steel cage 14 so that the reinforcement bars 11 of the steel cage 14 extend through the reinforcement bar apertures 8 of the bottom plate 6 and come into direct contact with the lower side of the top plate 6 of the cap structure A (FIG. 5). As a given number of traverse bars 15 have been stud welded to the vertical reinforcement bars 11 forming the steel cage 14, the uppermost bar 15 is joined at some points by the same stud welding to the bottom plate 6 of the cap structure A.

After the steel cage 14 is crowned with the cap structure A, it is installed in the drilled hole 17 as shown in FIG. 6. After a secondary slime removal process has been executed if desired, the tremie pipe 16 is inserted through the inner cylinder 2 into the drilled hole 17 and a batch of concrete is poured.

The placement of concrete is finished when the batch of concrete reaches and exceeds the top plate 1 in the inner cylinder 2 of the cap structure A. After the placement of the concrete, the slime or digger bucket 18, depending on the condition of a site, mounted on the kelly bar 19, is introduced and rotated to remove a sediment of concrete slime from the inner cylinder 2 of the cap structure A. This is followed by removing the protective casing 13 from the drilled hole 17, locating a lid on the cap structure A, and covering them thoroughly with refilling soil for curing the concrete.

When the concrete has been cured, the refilling soil is removed in order to expose the cap structure A. The process of removing the cap structure A from the steel cage 14 comprises dismounting the top plate 1 and withdrawing the outer cylinder 3 and the inner cylinder 2 with the use of an appropriate machine such as a power shovel. As the stud welding allows ease of the removal action, the bottom plate 6 is also ripped off by separating along some of the slits 9 with a gas burner. As the cap structure A was assembled by the stud welding method, its assembling time will be minimized and its removal will be eased. This provides an economic advantage.

After the cap structure A has been removed, the extensions of the reinforcement bars 11 are exposed successfully. The procedure of concrete pile placement is hence completed after residual concrete slime and laitance are washed out using a jet of high pressure water.

Figure 8:
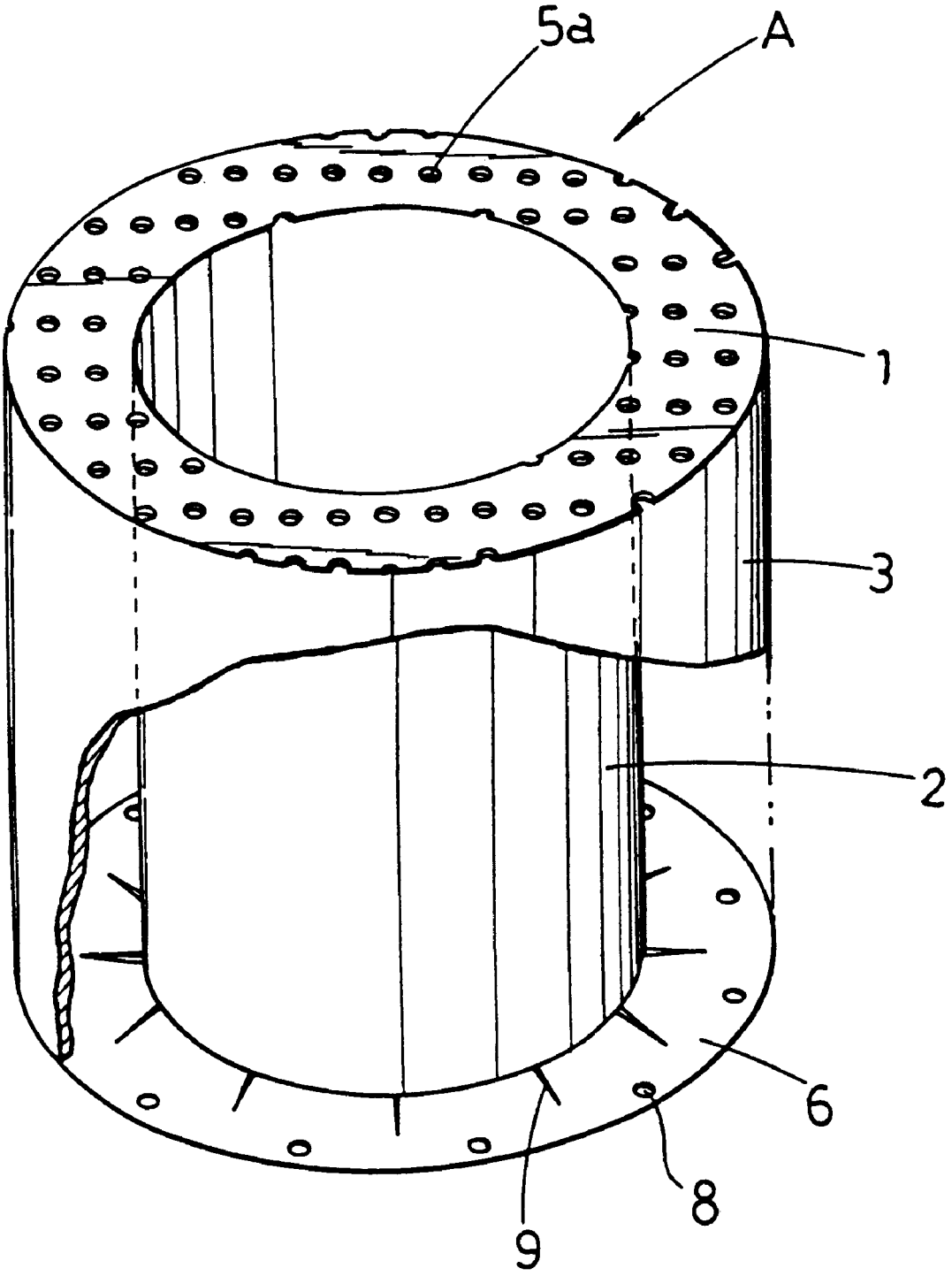
FIG. 8 is a partially cut-away perspective view of another embodiment of the cap structure.

FIG. 8 illustrates another embodiment of the cap structure A in which a top plate 1 is made of a perforated metal sheet having a multiplicity of apertures 5*a* therein for allowing a mixture of air and slurry to pass smoothly between an inner cylinder 2 and an outer cylinder 3. A bottom plate 6 similar to that of the previous embodiment has reinforcement bar apertures 8 and slits 9. The inner cylinder 2 may be arranged smaller in length than or equal to the length of the outer cylinder 3. When the inner cylinder 2 and the outer cylinder 3 are identical in length to each other, the bottom plate 6 extends horizontally at the bottom between the inner cylinder 2 and the outer cylinder 3. The use of the cap structure A of this embodiment is identical to the previous one and will be explained in no more detail. The top plate 1 is not limited to the perforated metal sheet but may be a mesh sheet or a like material which can pass the mixture of air and slurry while having a predetermined mechanical strength and satisfying safety and cost requirements.

Figure 9:
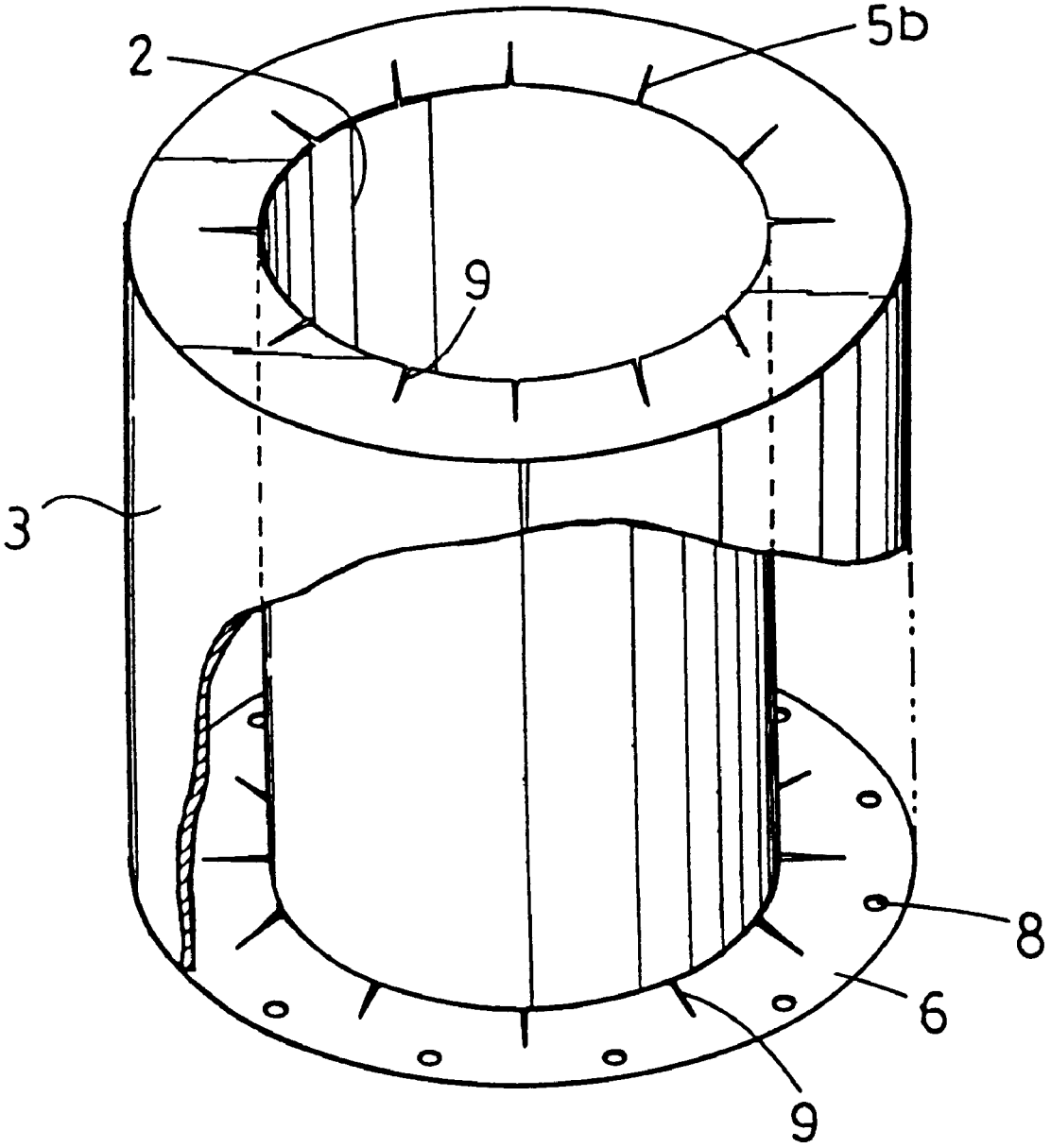
FIG. 9 is a partially cut-away perspective view of a further embodiment of the cap structure.

FIG. 9 shows a further embodiment of the cap structure A in which a top plate 1 has a plurality of slits 9*a* therein for allowing a mixture of air and slurry to pass smoothly between an inner cylinder 2 and an outer cylinder 3. Other components and their arrangement are identical to those of the previous embodiment.

Figure 10:
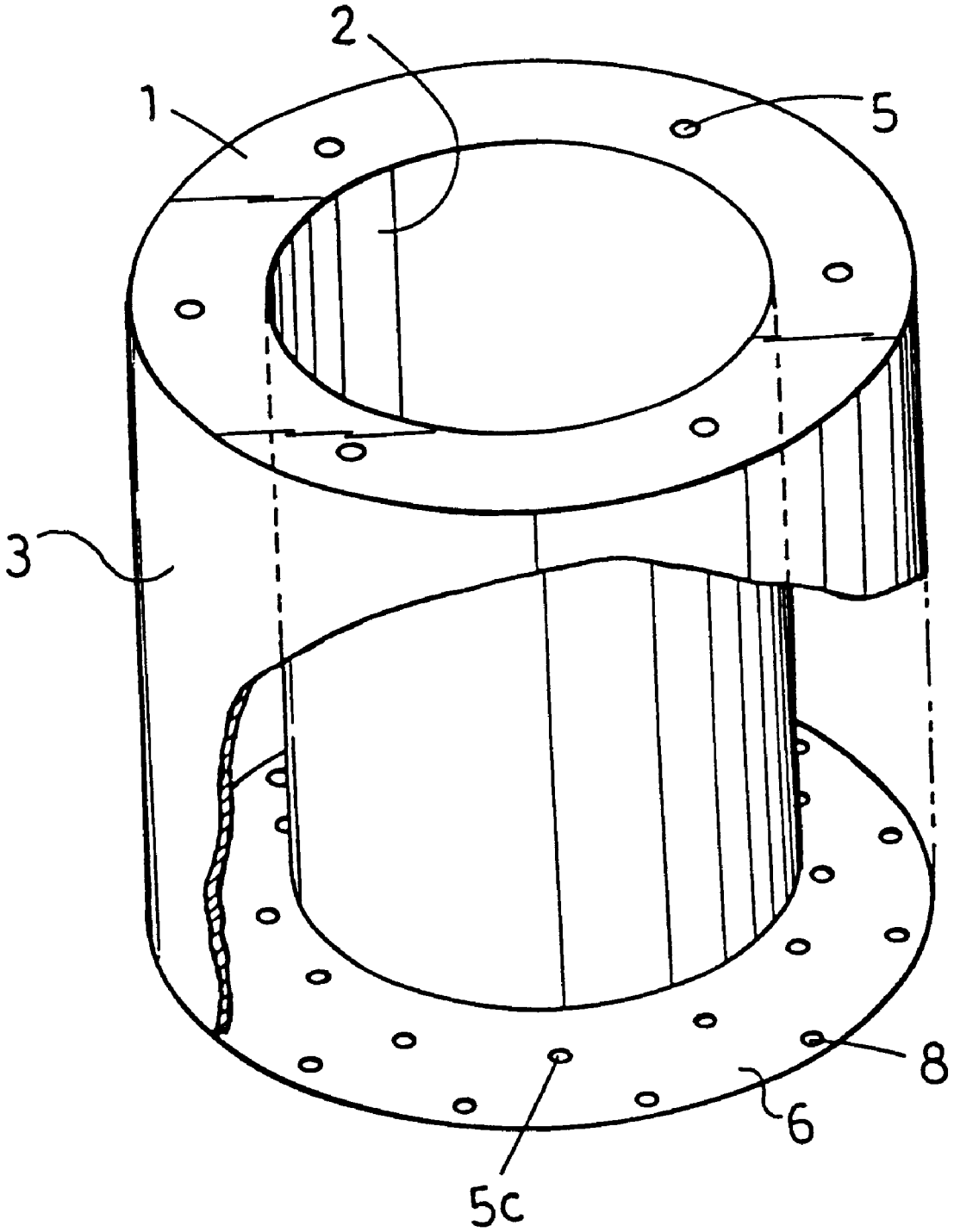
FIG. 10 is a partially cut-away perspective view of a still further embodiment of the cap structure.

FIG. 10 illustrates a still further embodiment of the cap structure A in which a top plate 1 has a plurality of exhaust apertures 5 therein and a bottom plate 6 has a greater number of apertures 5*c* formed therein which serve as the reinforcement apertures 8 and the slits 9. Other components and their arrangement are identical to those of the previous embodiment.

In each of the above embodiments, the inner cylinder 2 may be arranged equal in the length or shorter than the outer cylinder 3. While the reinforcement bar apertures 8 in the bottom plate 6 are obligatory, the other apertures and slits in the top plate 1 and the bottom plate 5 are illustrative and may be modified in shape, size, and number depending on the particular application.

Figure 11:
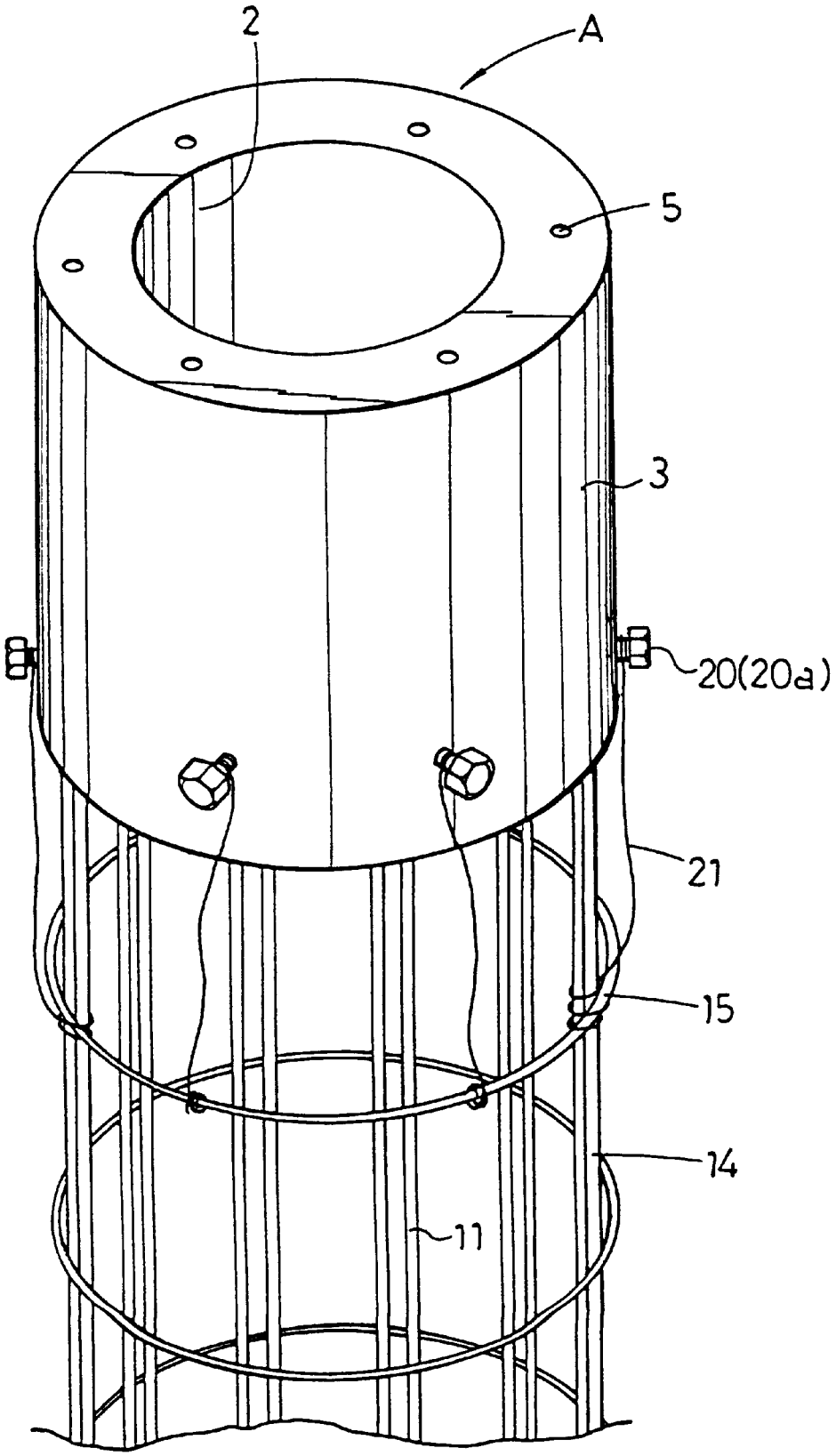
FIG. 11 is a partially cut-away perspective view showing a still further embodiment of the cap structure in use.

FIG. 11 shows a still further embodiment of the cap structure A in which retaining members 20 are mounted to a lower region of the side surface of the outer cylinder 3. In this embodiment, the retaining members 20 are bolts 20*a* screwed into threaded apertures in the outer cylinder 3. Each of the bolts 20*a* is fastened to one end of a tie material 21 such as a steel wire or string.

When the cap structure A is fitted on the steel cage 14, the other ends of the tie materials 21 are tightened to one of the traverse reinforcement bars 15 to secure the cap structure A. This allows the cap structure A to stay in its position while being retained by the tie material 21 even if an upward stress is exerted on the cap due to the escape of the mixture of air and slurry, a majority of which is relieved by the apertures and slits, during the placement of concrete.

Figure 12:
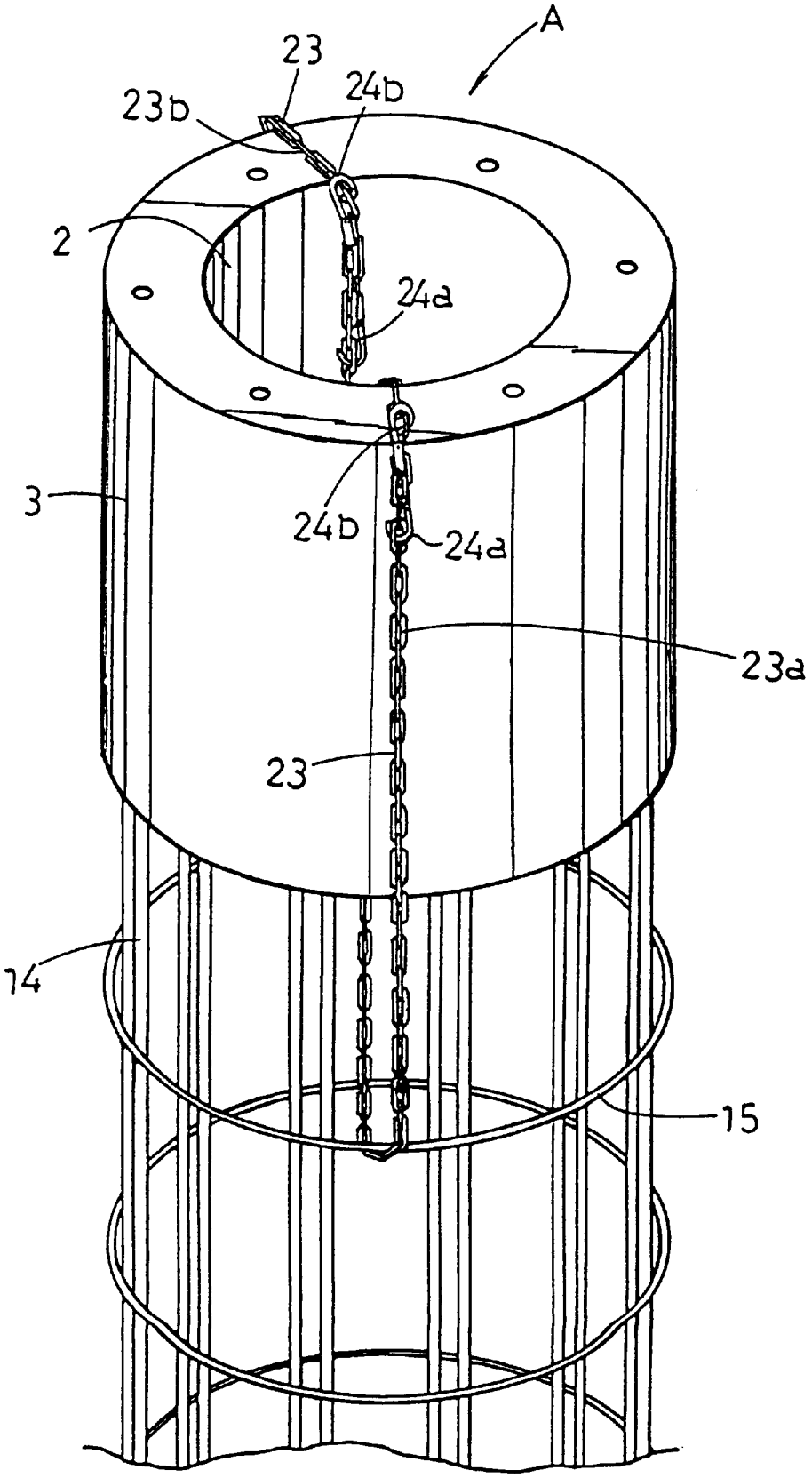
FIG. 12 is a perspective view showing a still further embodiment of the cap structure in use.

FIG. 12 is a view showing a further embodiment in which the retaining members 20 are replaced with a set of chains 23, e.g. a pair of claims 23*a* and 23*b*, for fastening the cap structure A to the steel cage 14. The chain 23*a* is looped with its end hooks 24*a* and 24*b* tightened to each other so that it extends downwardly along the side surface of the outer cylinder 3 to one of the traverse reinforcement bars 15 of the steel cage 14 and upwardly therefrom along the side surface of the inner cylinder 2. The other chain 23*b* is also looped in the same manner at an opposite location relative to the chain 23*a*. The chains 23 may be replaced with cables, heavy wires, and other materials which are rigid enough to fasten the cap structure A to the reinforcement bar 15 of the steel cage 14.

Accordingly, the cap structure A is held in its position while being tightened to the steel cage 14 by the chains 23*a* and 23*b* even when an upward stress is exerted on the cap due to the escape of the mixture of air and slurry during the placement of concrete, although a majority of the stress is relieved by the apertures and slits.

The cap structure A of this embodiment is easily released from the protective casing 13 after the placement of concrete as compared with the preceding one in which the bolts 20*a* (FIG. 11) may obstruct the removal from the casing 13.

A further embodiment of the present invention will now be described in the form of a method of cast-in-place concrete pile placement.

The method of the present invention comprises installing a steel cage 2A in a drilled hole 1A as holding it with an enclosure 3A, and filling the enclosure 3A with a batch of concrete 4A to form a concrete pile.

As shown in FIG. 16, the steel cage 2A is made of an assembly of vertical reinforcement bars 21A and hoop ties 22A and can be installed in the drilled hole 1A using a crane or hoist.

The steel cage 2A is sized so as to have a clearance between the inner wall of the drilled hole 1A where spacers 23A are disposed for developing an overcoating.

Figure 15A:
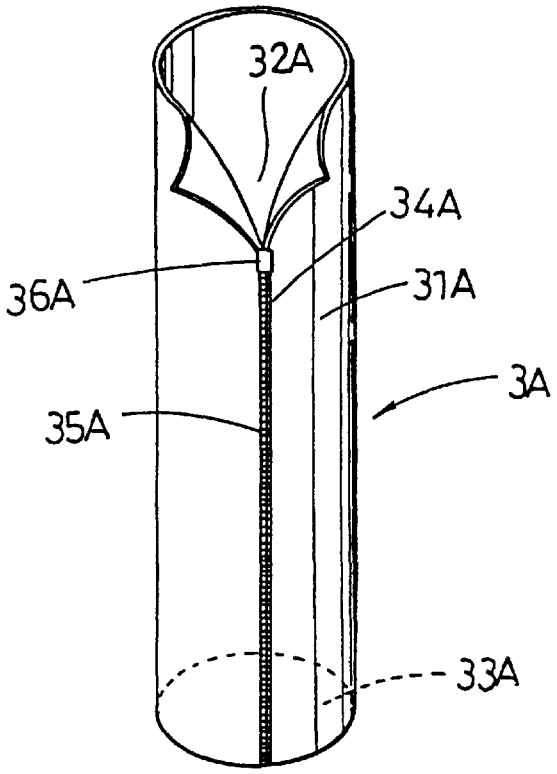
FIGS. 15A–15B are perspective views of a bag enclosure used in the method.

The enclosure 3A is made of a sheet tube having an open top and a closed bottom, as best shown in FIG. 15(A). A tube 31A of the enclosure 3A has a deep slit 32A therein extending vertically close to the closed bottom 33A so that it can be opened along the slit 32A. The slit 32A is closed with a fastener 34A which comprises a row of teeth 35A and a slider 36A. The slider 36A is provided with a grip 36*a* which has a hook shape.

The enclosure 3A is made of a heavy-duty sheet of a fabric or rubber material reinforced with a nylon or synthetic resin meshing (not shown).

Figure 16C:
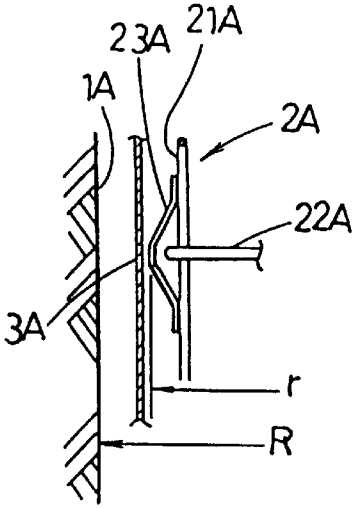
FIGS. 16A–16C are perspective views showing steps of the installation of a steel cage in the method.

The inner diameter of the tube 31A of the enclosure 3A is larger than the diameter r of the steel cage 2A between the opposite spacers 23A, as shown in FIG. 16(C). The outer diameter of the tube 31A is then smaller than the diameter R of the drilled hole 1A.

The procedure of carrying out the method with the enclosure 3A will be explained.

(1) Drilling of Hole

Figure 13A:
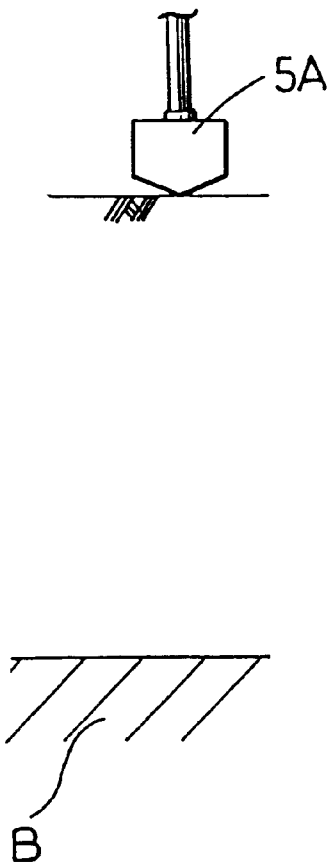
FIGS. 13A–13D are cross sectional views showing a procedure of carrying out the drilling steps of a cast-in-place concrete pile placing method of the present invention.
Figure 13B:
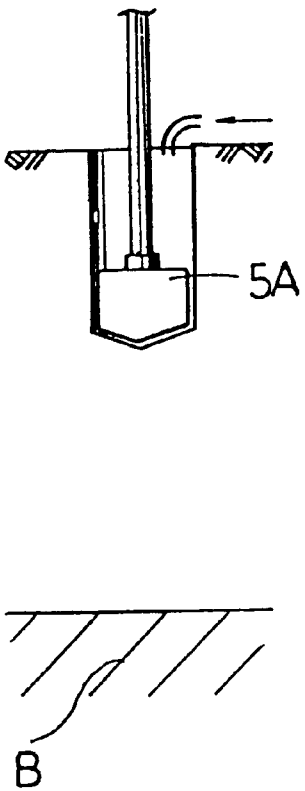
Figure 13C:
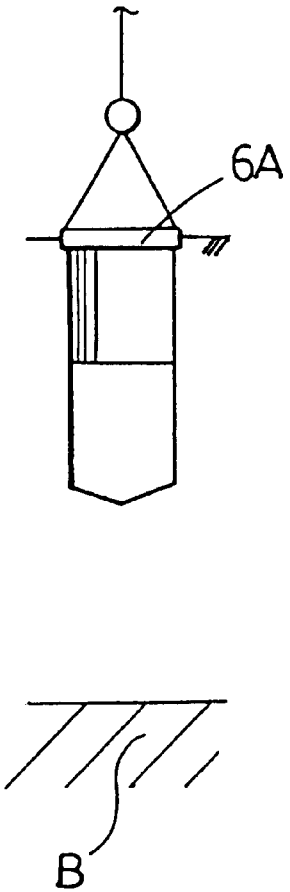
Figure 13D:
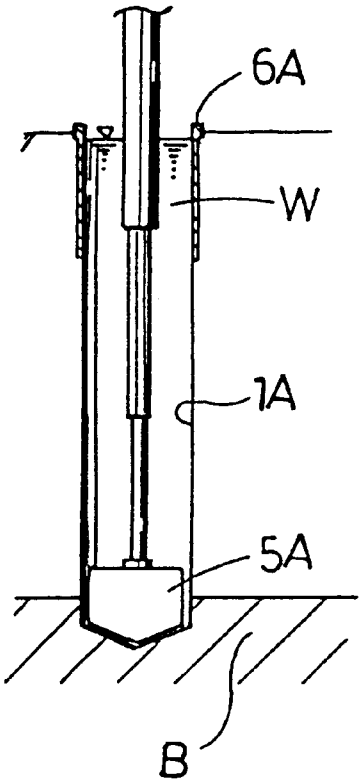

The procedure starts with locating and drilling a pilot hole by means of a digger or auger bucket 5A, as shown in FIGS. 13(A) and 13(B). A protective casing 6A is fitted in the pilot hole as shown in FIG. 13(C) and the action of the auger bucket 5A is continued until it reaches the support base ground B as shown in FIG. 13(D).

(2) Setting of Enclosure 3A

Figure 16B:
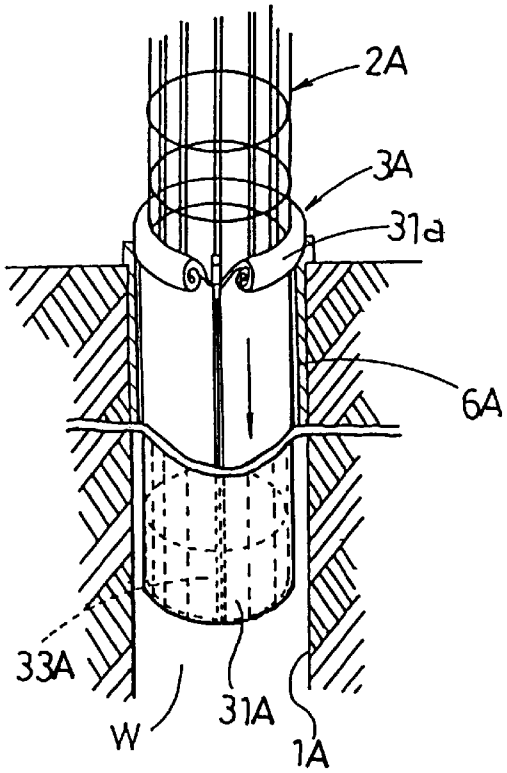
Figure 16A:
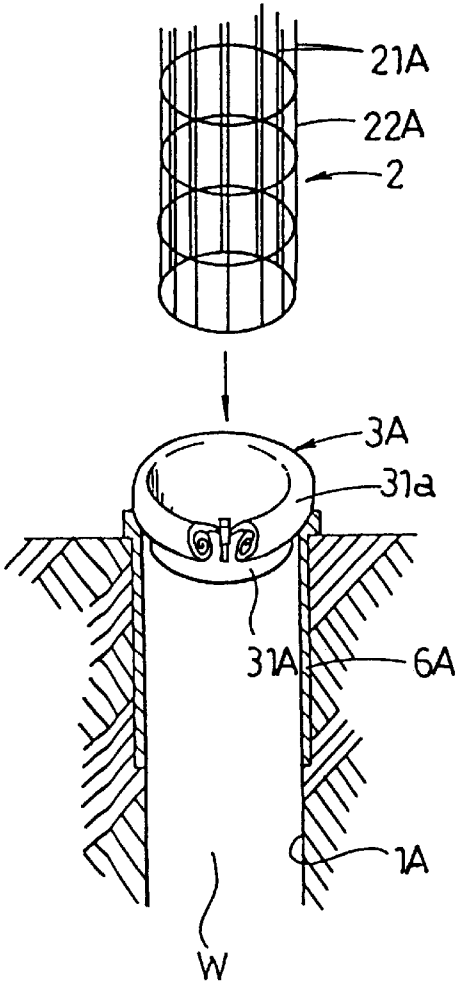
Figure 17:
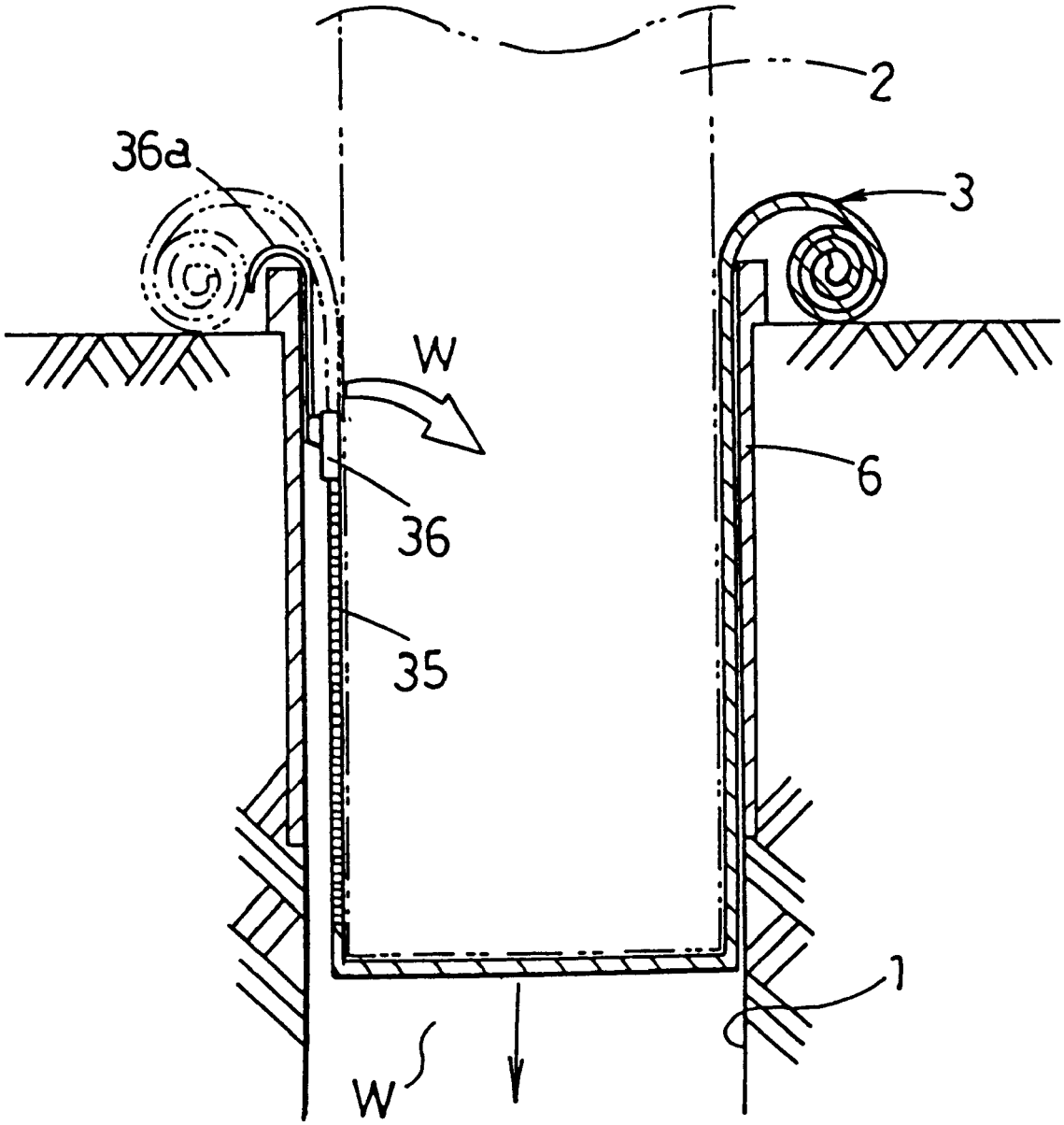
FIG. 17 is an enlarged cross sectional view showing steps of the installation of a steel cage in the method.

After the drilled hole is completed, the enclosure 3A in its rolled form 31*a* is placed with its bottom 33A seated across the opening of the drilled hole 1A, as shown in FIGS. 15(A) and 16(A). At the time, the tube 31A of the enclosure 3A is rolled and remains open with the slider 36A located at the lowermost of the fastener 34A.

The grip 36*a* of the slider 36A of the fastener 34A is then hooked to the protective casing 6A in the drilled hole 1A.

(3) Installation of Steel Cage 2A

Figures 14A, 14B, 14C, 14D, 14E, 14F:
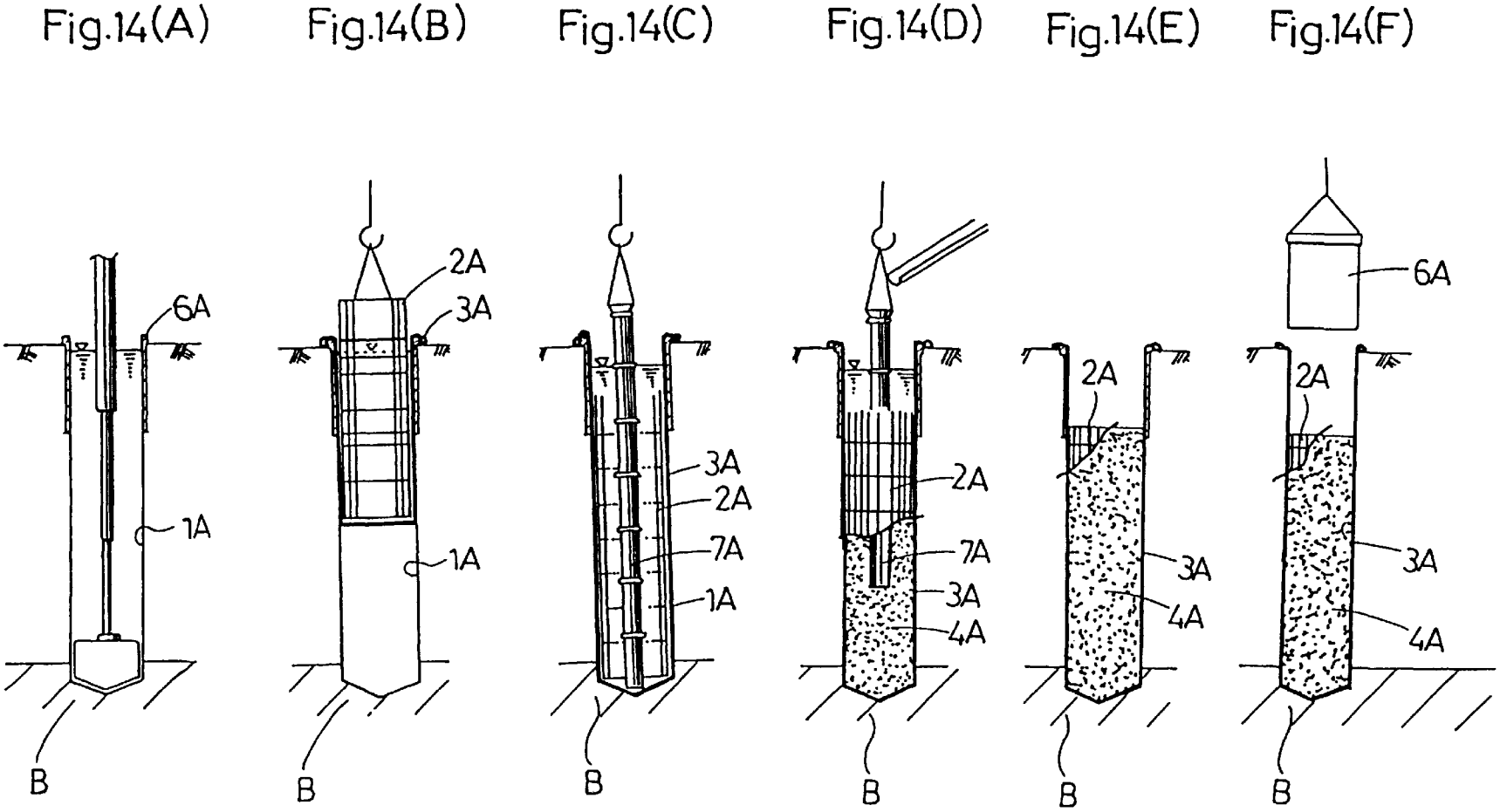
FIGS. 14A–14F are cross sectional views showing a procedure from the installation of a steel cage to the final step of the method.

The steel cage 2A is lowered into the drilled hole 1A as shown in FIG. 14(A).

More particularly, the steel cage 2A is slung by a crane (not shown) and moved down into the drilled hole 1A, as best shown in FIGS. 14(B) and 16(A).

As the steel cage 2A moves downwardly, its lower end presses and drives the bottom 33A of the enclosure 3A to the bottom of the drilled hole 1A, as shown in FIG. 16(B). Simultaneously, the tube 31A of the enclosure 3A in the rolled form 31*a* is unrolled and stretched throughout the drilled hole 1A. The release of the rolled form 31*a* may be assisted manually by a worker.

While the slider 36A is hooked up, the fastener 34A is being closed as the steel cage 2A is lowered and thus, the slit 32A of the tube 31A of the enclosure 3A is closed. Meanwhile, a water inflow W moves into the enclosure 3A through its slit 32A.

When the steel cage 2A has been installed, the enclosure 3A is filled with water as shown in FIG. 14(C).

(4) Placement of Concrete

A batch of concrete 4A is poured into the drilled hole 1A from a tremie pipe 7A, as shown in FIG. 2(D).

The tremie pipe 7A is lifted up as the level of the concrete 4A rises, as shown in FIGS. 14(E) and 14(F).

During the concrete placement, the enclosure 3A acts as a concrete form to retain the concrete 4A and separate the steel cage 4A from the inner wall and bottom of the drilled hole 1A. Accordingly, sediments of slime on the bottom of the drilled hole 1A will be prevented from mixing with the concrete 4A of which quality is not degraded.

No slime or laitance appears in the top skim of the concrete 4A and an extra amount of concrete is not needed. In other words, the chipping process is not necessary when the concrete 4A has solidified.

The protective casing 6A is removed after the placement of the concrete 4A is completed, as shown in FIG. 14(F).

Figure 15B:
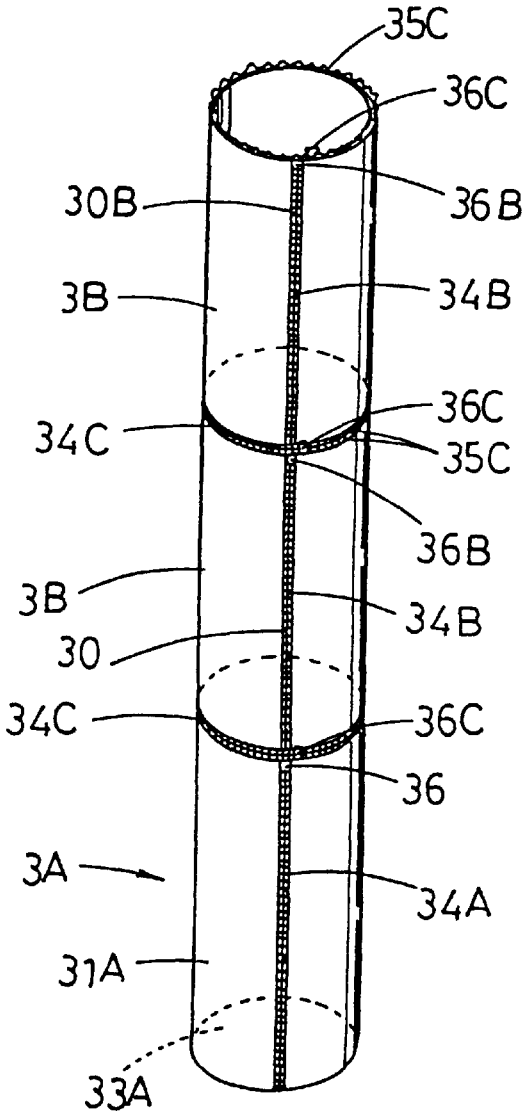

The tube 31A of the enclosure 3A may be joined with another tube structure 3B if two or more of the steel cages 2A are used as shown in FIG. 15(B).

The tube structure 3B is made of the same material as of the enclosure 3A and has a vertically extending slit therein from top to bottom for opening. A fastener 34B is mounted along the slit for closing the tube 3B.

As the two steel cages 2A have been joined to each other, the tube 3B is also joined by a fastener 34C to the tube 31A of the enclosure 3A so that the two tubes can be stretched throughout the drilled hole 1A.

The fastener 34C has a pair of teeth 35C, one mounted to the uppermost end of the tube 31A of the enclosure 3A and the other mounted to the lowermost end of the tube structure 3B.

Also, shown are a slider 36B of the fastener 34B and a slider 36C of the slider 34C.

The joining of the tube 3A to the other 3B is not limited to the fastener 34C but may be implemented using a fast-bonding or instant adhesive.

As shown in FIG. 15(B), the tube 3B may be joined to another 3B by the fastener 34C or adhesive.

Figure 18:
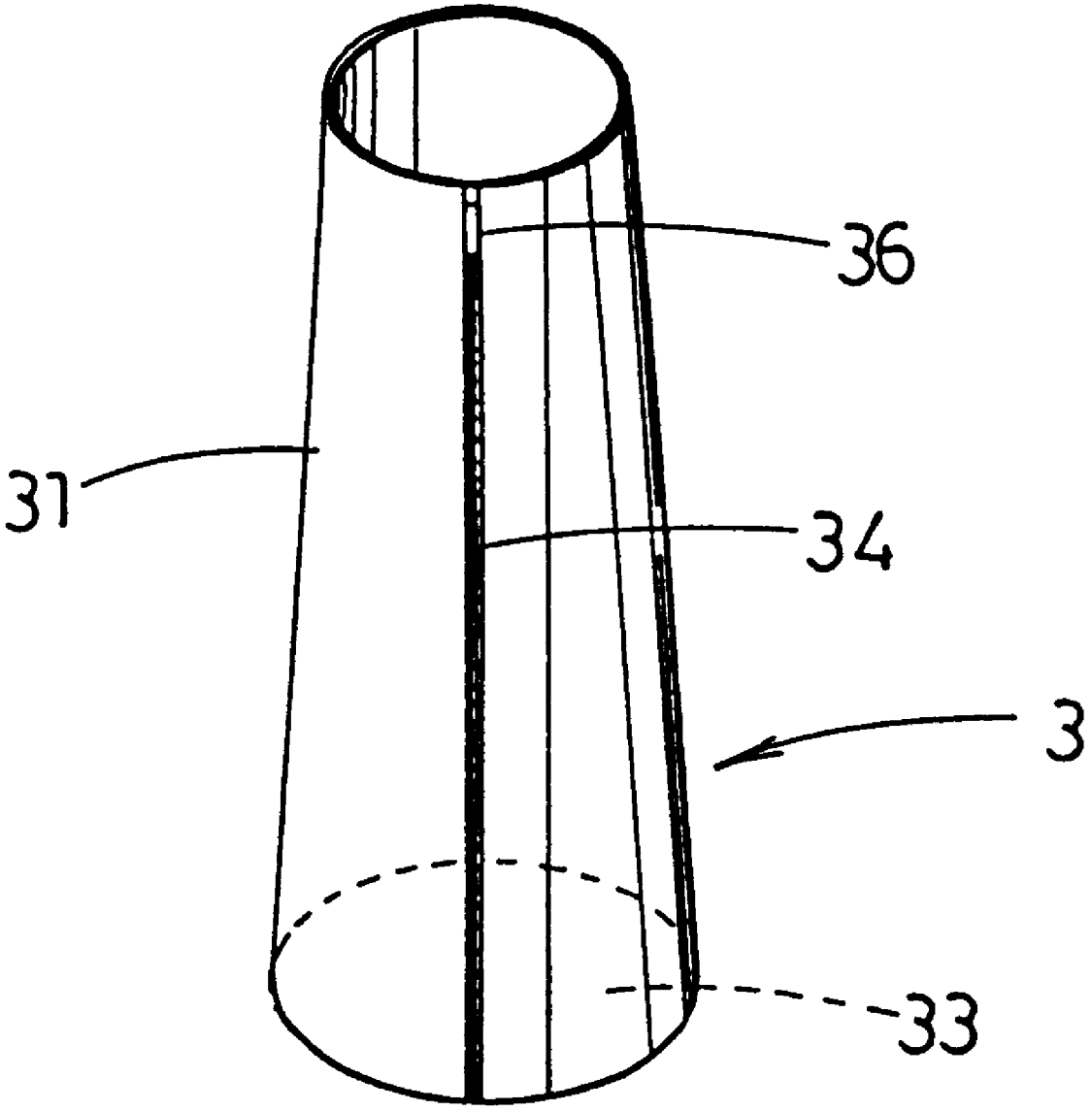
FIG. 18 is a perspective view of a bag structure of another embodiment of the method.
Figure 19A:
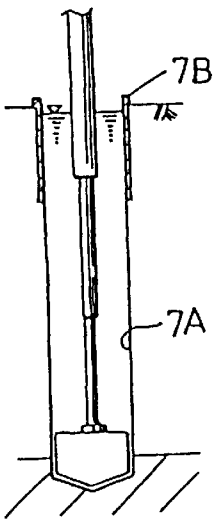
Prior Art Fig.19(A)
FIGS. 19A–19G are cross sectional views showing a conventional cast-in-place concrete pile placing method.
Figure 19B:
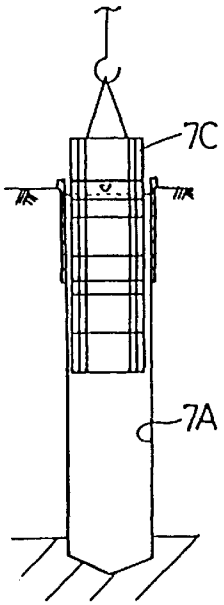
Figure 19C:
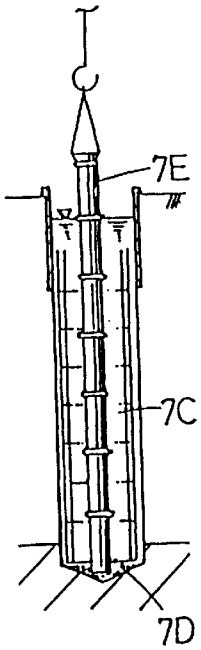
Figure 19D:
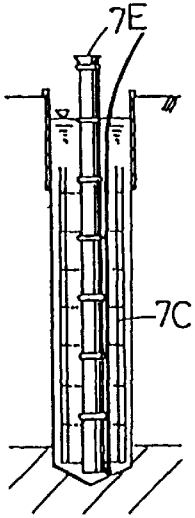
Figure 19E:
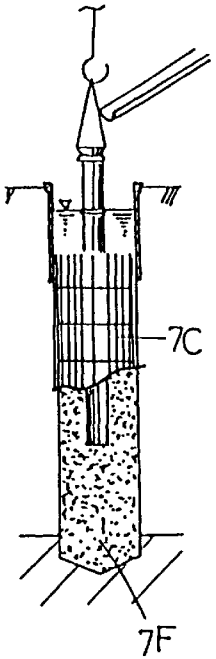
Figure 19F:
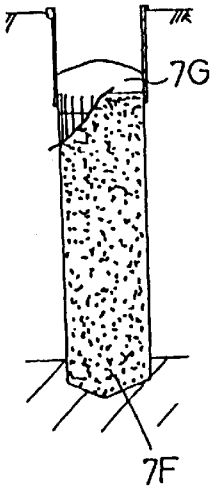
Figure 19G:
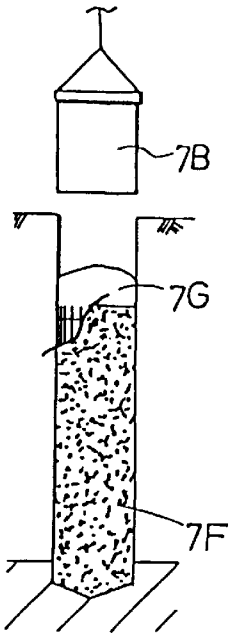

For placement of a counter-tapered concrete pile, the enclosure 3A may have a corresponding shape as shown in FIG. 18. In that case, the bottom of the enclosure 3A is folded and located across the opening of a drilled hole 1A.

The present invention is used for a pile head dresser which is mounted to the head of a steel cage of a cast-in-place concrete pile installed in the ground for making a foundation of civil engineering project, and for a method of dressing the head of such a concrete pile, and as for placement of such a pile.

What is claimed is:

1. A pile head dresser for cast-in-place concrete piles, said pile head dresser comprising:

an inner cylinder adapted to receive a tremie pipe;

an outer cylinder surrounding said inner cylinder and spaced therefrom by a predetermined distance;

a top plate extending between upper edges of said inner and outer cylinders, said top plate being provided with a plurality of exhaust apertures for allowing a mixture of air and slurry to pass therethrough; and a bottom plate extending between lower edges of said inner and outer cylinders, said bottom plate being provided with a plurality of reinforcement bar apertures and a plurality of exhaust openings for allowing a mixture of air and slurry to pass therethrough, wherein said reinforcement bar apertures are spaced at equal intervals from each other along said bottom plate.

2. A pile head dresser as claimed in claim 1, wherein said inner cylinder has a length which is equal to a length of said outer cylinder, and said top and bottom plates extend horizontally between said inner and outer cylinders.

3. A pile head dresser as claimed in claim 1, wherein at least one of said top plate and said bottom plate is formed of a mesh material or a perforated metal sheet.

4. A pile head dresser for cast-in-place concrete piles, said pile head dresser including a double cylinder construction comprising:

an outer cylinder;

an inner cylinder disposed within said outer cylinder and having an open lower end and an open upper end defining an upper tremie opening, said inner cylinder being 2% to 3% shorter than said outer cylinder;

a top plate connecting upper ends of said inner and outer cylinders, said top plate having a plurality of exhaust apertures formed in an outer edge region of said top plate for permitting a mixture of air and slurry to pass; and a bottom plate extending between said inner and outer cylinders and having an outer flat region, a plurality of equally spaced reinforcement bar apertures formed in the outer flat region, a plurality of equally spaced slits extending radially from the outer flat region to an inner periphery of said bottom plate so as to define a plurality of the equally spaced tabs having radially arranged inner ends, respectively, wherein said tabs are bent upwardly and each of said radially inner ends is welded to the open lower end of said inner cylinder.

5. A pile head dresser as claimed in claim 4, wherein at least one of said top plate and said bottom plate is formed of a mesh material or a perforated metal sheet.

6. A pile head dresser as claimed in claim 4, further comprising fastening means for securing said double cylinder construction to a steel cage.

7. A pile head dresser as claimed in claim 6, wherein said fastening means comprises a plurality of retaining members attached to an outer peripheral surface of said outer cylinder, and a plurality of tying materials connected to said retaining members, respectively.

8. A pile head dresser as claimed in claim 6, wherein said fastening means comprises a plurality of chain loops extending through said inner cylinder and along an outer peripheral surface of said outer cylinder.

9. A method of placing a cast-in-place concrete pile, said method comprising:

a) joining a cap structure to a steel cage by stud welding, wherein said cap structure includes:

an inner cylinder adapted to receive a tremie pipe;

an outer cylinder surrounding said inner cylinder;

a top plate extending between upper edges of said inner and outer cylinders, said top plate being provided with a plurality of air and slurry exhaust apertures; and a bottom plate extending between lower edges of said first and second cylinders, said bottom plate being provided with a plurality of reinforcement bar apertures and a plurality of air and slurry exhaust openings, said reinforcement bar apertures being spaced at equal intervals;

b) inserting a tremie pipe through the inner cylinder of the cap structure into a hole drilled in a ground surface;

c) pouring a batch of concrete continuously into the drilled hole until the concrete rises from a bottom of the drilled hole to the top of the inner cylinder; and d) rotating, in the inner cylinder, a digger bucket mounted to a kelley bar to remove sediments of concrete slime from the inner cylinder.

10. A method of placing a cast-in-place concrete pile, said method comprising:

drilling a hole in a ground surface;

preparing a bag enclosure formed of a sheet material, wherein the bag enclosure is a closed bottomed cylindrical structure having a longitudinally extending slit, and a fastener arranged along the slit;

installing the bag enclosure, in a rolled form with the fastener in an open position, across an upper opening of the drilled hole;

connecting a slider of the fastener to the upper opening of the drilled hole, wherein the slider is disposed near the closed bottom of the cylindrical structure when the fastener is in the open position;

lowering a steel cage into the drilled hole so that the fastener of the bag enclosure closes the slit as the steel cage is lowered into the drilled hole;

delivering a flow of water through the slit into the bag enclosure as the steel cage is lowered into the drilled hole; and pouring a batch of concrete into the bag enclosure.

* * * * *